United States Patent [19]

Anderson et al.

[11] Patent Number: 4,993,288

[45] Date of Patent: Feb. 19, 1991

[54] POWER DRIVEN REPLACEMENT SOCKET RATCHET WRENCH

[75] Inventors: Marvin L. Anderson, Williston, N. Dak.; Gerald O. Irvine, Crosby, Minn.; Christopher A. Lindenberger, Arvada, Colo.

[73] Assignee: Circle A Products, Inc., Sioux City, Iowa

[21] Appl. No.: 296,357

[22] Filed: Jan. 10, 1989

Related U.S. Application Data

[63] Continuation of Ser. No. 82,974, Aug. 3, 1987, abandoned, which is a continuation of Ser. No. 866,594, May 23, 1986, abandoned, which is a continuation-in-part of Ser. No. 762,115, Aug. 2, 1985, abandoned.

[30] Foreign Application Priority Data

Jun. 28, 1986 [TW] Taiwan ..... 75102960
Apr. 27, 1987 [CA] Canada ..... 535628

[51] Int. Cl.[5] ..... B25B 13/46

[52] U.S. Cl. ..... 81/57.39; 81/177.9; 81/61

[58] Field of Search ..... 81/54, 57.13, 57.26, 81/57.28, 57.29, 57.39, 57.44, 57.45, 60–63.2, 177.9

[56] References Cited

U.S. PATENT DOCUMENTS

| | | | |
|---|---|---|---|
| 603,377 | 5/1898 | Fitch . | |
| 613,153 | 10/1898 | Kennelly . | |
| 635,207 | 10/1899 | Tilton . | |
| 1,292,281 | 1/1919 | Esterhay . | |
| 1,451,498 | 4/1923 | Faitz . | |
| 1,650,085 | 11/1927 | McDonough . | |
| 1,769,070 | 7/1930 | Nowosielski . | |
| 1,995,009 | 3/1935 | Pfauser et al. | 192/43.2 |
| 2,119,968 | 6/1938 | Shaff . | |
| 2,358,362 | 9/1944 | Taylor | 81/60 |
| 2,491,624 | 12/1949 | Shaff | 74/60 |
| 2,536,172 | 1/1951 | Halperin | 81/60 |
| 2,657,604 | 11/1953 | Rueb | 81/63.2 |
| 2,711,111 | 6/1955 | Brame . | |
| 2,723,580 | 11/1955 | Brame . | |
| 2,725,771 | 12/1955 | Arnold | 81/61 |
| 3,044,591 | 7/1962 | Kilness | 192/43.1 |
| 3,077,801 | 2/1963 | Rostad | 81/61 |
| 3,078,973 | 2/1963 | Kilness | 192/43.2 |
| 3,096,659 | 7/1963 | Jenkins | 74/157 |
| 3,186,265 | 6/1965 | Wenturine et al. | 81/177.9 |
| 3,233,481 | 2/1966 | Bacon | 81/63 |
| 3,253,626 | 5/1966 | Stillwagon, Jr. et al. | 145/50 |
| 3,299,750 | 1/1967 | Campanile et al. | 81/62 |
| 3,475,999 | 11/1969 | Roberts et al. | 81/63 |
| 3,529,498 | 9/1970 | Northcutt | 81/57.13 |
| 3,602,071 | 8/1971 | Johnson | 81/57.14 |
| 3,732,756 | 5/1973 | Thomasian | 81/62 |
| 3,791,242 | 2/1974 | Bartusch | 81/57.13 |
| 3,881,376 | 5/1975 | Wright | 81/63 |
| 4,095,494 | 6/1978 | Castoe | 81/63.2 |
| 4,259,883 | 4/1981 | Carlson | 81/60 X |
| 4,308,768 | 1/1982 | Wagner | 81/60 |
| 4,328,720 | 5/1982 | Shiel | 81/63 |
| 4,346,630 | 8/1982 | Hanson | 81/57.29 X |
| 4,372,181 | 2/1983 | Tinsley | 81/57.39 |
| 4,475,420 | 10/1984 | Atkinson et al. | 81/58.3 |

FOREIGN PATENT DOCUMENTS

| | | |
|---|---|---|
| 3219980 | 6/1983 | Fed. Rep. of Germany . |
| 1419167 | 10/1965 | France . |

OTHER PUBLICATIONS

WO-8502806, International Application Under PCT, 7/4/85, Mayer.

*Primary Examiner*—D. S. Meislin
*Attorney, Agent, or Firm*—Kinney & Lange

[57] ABSTRACT

A power driven socket holding ratchet wrench which has a socket made so that it has a central opening that may be used for receiving a long stud or member, which passes through the socket. The wrench acts much like a box end wrench. The wrench is made so that it can be relatively compact in axial height, that is, along the length of the sprocket and the frame is small in diameter relative to the socket size to permit it to fit into tight places. The power drive is capable of being positioned at an angle relative to the wrench head, and the wrench includes a unique ratcheting and quick release mechanism that facilitates the operation of the unit.

9 Claims, 4 Drawing Sheets

Fig.1
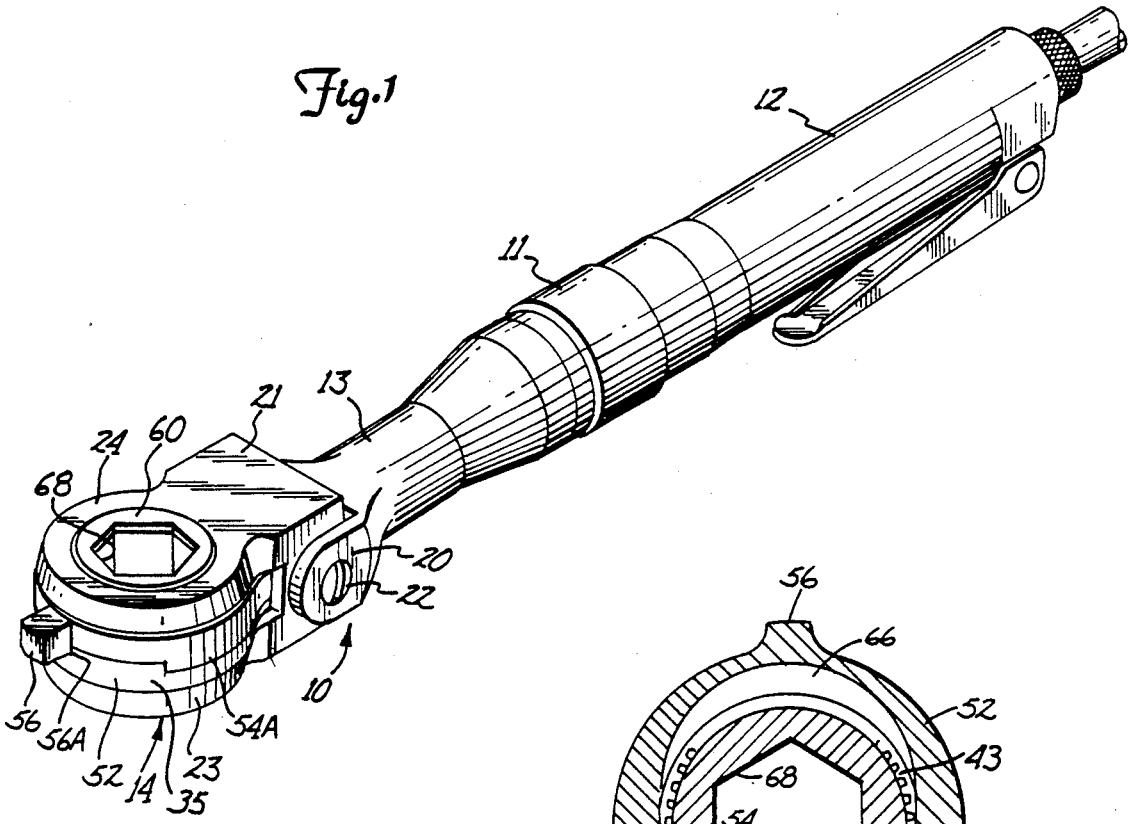
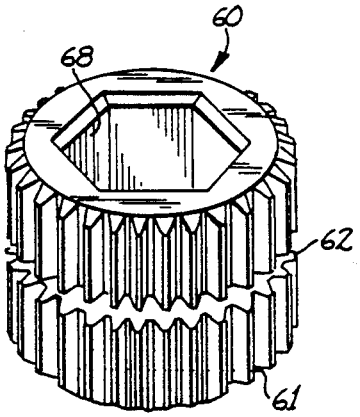
Fig.5
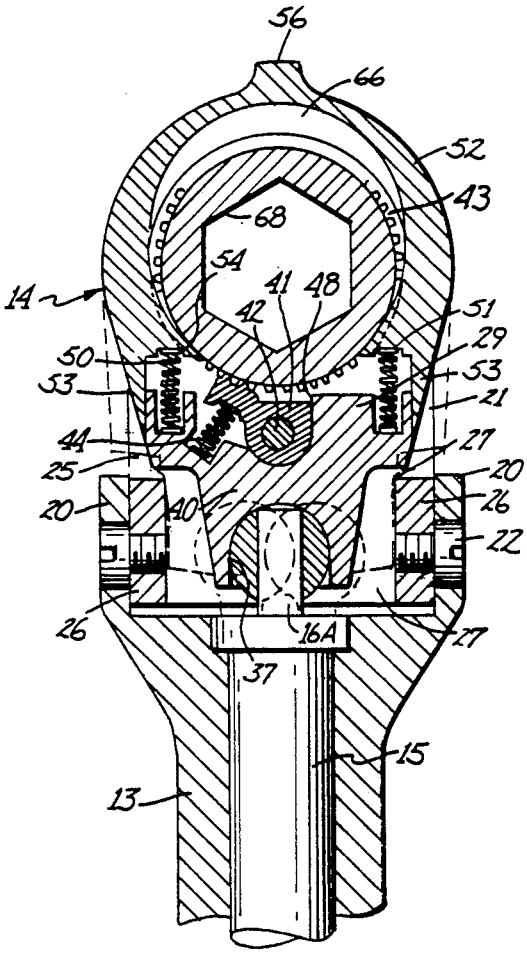
Fig.2

POWER DRIVEN REPLACEMENT SOCKET RATCHET WRENCH

CROSS-REFERENCE RELATED TO APPLICATIONS

This application is a Continuation of our application Ser. No. 07/082,974, filed Aug. 3, 1987, now abandoned, which in turn was a Continuation of our application Ser. No. 06/866,594, filed May 23, 1986, now abandoned, and which, in turn, was a Continuation-In-Part of our application 06/762,115, filed Aug. 2, 1085, now abandoned.

BACKGROUND OF THE INVENTION

1. Field of the Invention.

The present invention relates to power driven socket-type ratchet wrenches

2. Description of the Prior Art.

The number of ratchets that have been advanced over the years is legion. The need for dependable and convenient operation, as well as compact size for moving into small spaces has been desired. There have been well known power driven ratchet wrenches such as the pneumatic wrench made by Universal Tool of 18125 Ammi Trail, Houston, Tex. 77060. The ratchet head for the tool is driven by a small crank that has a pin which drives the ratcheting mechanism. However, the ratchet itself is a conventional enclosed ratchet, and while reversible, it does not include several desired features, such as the ability to operate on long studs or bolts.

Representative of socket wrenches that have through openings in the socket is the device shown in U.S. Pat. No. 4,259,883. It has an interchangeable socket member nested in an outer ring, and drive teeth on the exterior of the ring. A ratchet pawl that will engage these teeth for driving the socket with the head and handle is provided.

The socket is retained in place within the drive ring with a wire spring member which can be released for dropping the socket out and replacing it with another. The through opening in the socket permits a stud to pass through the socket itself when the socket is being operated.

The socket has substantial vertical height, and in view of the retaining mechanism, the necessary vertical or axial height of the wrench and socket is increased substantially. Additionally, the mechanism for releasing the socket from the wrench has two members that are moved for deflecting the spring for removal of the socket. Because the socket itself is driven an outer ring or fitting additional mechanism is required for operation.

An early form of a type of socket that had a center opening in the socket itself and was used in a ratchet wrench is shown in U.S. Pat. No. 603,377, patented May 3, 1898 and issued to Fitch. This unit has a spring retainer that frictionally retains the socket in place, and uses, again, an outer drive member that ratchets. The outer drive member has an inner periphery that has, in this form, a square cross section for driving an insertable socket.

Another early patent, U.S. Pat. No. 635,207 issued to Tilton on Oct. 17, 1899, shows a socket wrench that has a center opening, but which uses a split handle and a very elementary socket drive. This socket, however, has large teeth on the outer surface of the socket. The socket is not easily removable, but is more or less permanently retained in place with the handle. The handle is split and can be separated for changing sockets. One of the features is that the socket has two different size openings, accessible from the opposite ends of the socket, for use with different size nuts.

U.S. Pat. No. 1,292,281 issued to Esterhay on Jan. 21, 1919, shows a ratchet wrench that has a handle, with a pawl that drives an outer ratcheting ring member, which is permanently mounted in the handle. The ring has exterior ratchet teeth thereon for driving, with a square internal opening, and a matching cross section socket that fits into the opening for replacement. The socket is mated in the drive ring with a key and slot arrangement.

U.S. Pat. No. 2,725,771 issued Dec. 5, 1955, to Arnold shows a power driven ratchet wrench having external teeth on the socket used for driving the socket, but utilizing a complex connecting rod arrangement for reciprocating the socket.

U.S. Pat. No. 3,529,498, issued Sept. 22, 1970 to Northcut also shows an eccentric drive ratchet wrench operating with a power motor, and having a ball type socket for driving an outer reciprocating element that operates to drive a ratchet pin that fits onto a conventional socket.

Other pneumatic or power wrenches are shown in U.S. Pat. No. 4,346,630, issued Aug. 31, 1982, to Hanson. This patent shows another type of power driven ratchet wrench utilizing an ordinary square socket drive and holder, and a reciprocating pawl that rotates with the portion driving the socket, and engages internal fixed gear teeth.

U.S. Pat. No. 3,077,801, issued Feb. 19, 1963 to Rostad shows an open end ratchet wrench that has a type of socket that has teeth on the outside, but an outer end flange that rests against a portion of the wrench proper, and which holds the socket in place. This is a hand driven ratchet wrench having an open slot at one side, so that it can be placed over a bolt or the like.

U.S. Pat. No. 1,451,498, issued to Faitz on Apr. 10, 1923, shows a ratchet wrench which has a drive pawl and drive ring mounted in the handle and a replaceable socket that fits within the ring. The socket has a through opening for receiving a stud or bolt. In this device, the socket has an outer cross section that fits into an opening in the ratchet drive ring for driving. This increases the size of the head of the socket wrench and makes it less accessible for small clearances.

U.S. Pat. No. 1,769,070 issued to Nowosielski on July 1, 1930, shows a ratchet wrench having a socket wheel that has teeth on the outer surface thereof and a pawl mounted directly in the handle, which reduces the height of the wrench in direction along the axis of rotation. The socket is retained with balls fitting into a groove around the periphery of the socket, and release of the socket for changing is more difficult with such arrangement.

U.S. Pat. No. 2,358,362 issued to Taylor on Sept. 19, 1944, also shows a ratchet wrench with a socket member that has teeth directly on the outside of the socket and which has a head member that forms a type of a "hook" ratchet. The head does not have a socket encircling ring, but rather the socket fits into a receptacle that is open on one side and the socket is retained in place with finger-like springs.

U.S. Pat. No. 2,536,172 issued to Halperin on Jan. 2, 1951, shows a ratchet wrench for turnbuckles that has a ratchet wheel that splits open and has a pin for driving the turnbuckle. The opening action is made so that the wrench can be placed around a continuous rod and operated to tighten or loosen a nut.

U.S. Pat. No. 3,299,750 issued to Campanile et al. on Jan. 24, 1967, shows a replaceable socket member that has a neck section with ratchet teeth on the socket, which has a single retaining ring that can be used for releasing the socket and replacing it with another. This socket also ratchets upon operation of the handle, and has a through opening for permitting a stud to pass completely through the socket so that the length of the stud or bolt being operated does not cause interference.

U.S. Pat. No. 3,732,756 issued to Thomasian on May 15, 1973, shows a socket having external teeth driven from the pawls of a ratchet wrench. The socket has different shaped openings at its opposite ends.

A ratchet lever is shown in U.S. Pat. No. 4,308,768 issued to Wagner on Jan. 5, 1982 and illustrates a type of socket to be driven which has a head ring for receiving an interchangeable locking ring. It does show a socket member that has a through opening as well.

U.S. Pat. No. 4,328,720 issued to Shiel on May 11, 1982, shows another type of sprocket that has a through opening, and which has means for retaining it in place and which has ratchet teeth on the outside. However, the unit is an insert socket arrangement, so that the ratchet drive is not to teeth on the socket itself.

Additional art of general interest is shown in U.S. Pat. No. 4,095,494 issued to Castoe on June 20, 1978, which shows a gear operated ratchet wrench that has a swing open frame for putting it onto a continuous member for tightening or loosening a portion of the member. U.S. Pat. No. 613,153 issued to Kennelly on Oct. 25, 1898, shows a outer drive housing that has teeth on the outside for driving the unit as a ratchet.

U.S. Pat. No. 3,602,071 shows a gear driven "open end" wrench. The wrench gear is driven by an air motor, but does not ratchet.

U.S. Pat. No. 4,475,420 issued to Atkinson et al on Oct. 9, 1984 is a wrench apparatus that shows a gear drive, and is merely of general interest. Additionally, there are a side number of conventional ratchet wrenches using sockets that do not have openings through the center.

SUMMARY OF THE INVENTION

The present invention relates to a ratchet adapted for power drive that is compact, easily fits into small spaces because it has low height, and which also provides for easily replaceable sockets. A frame member for the present ratchet mounts a ratcheting mechanism that is driven from a power driven crank to oscillate about the socket axis. The wrench includes a handle swivel mounting so that the motor used for driving can be tilted relative to the axis of the socket, other than at a perpendicular relationship. The sockets are retained with a spring loaded retainer which is quickly released, and have teeth defined on the outer surfaces thereof. A driven pawl member engages the teeth on the socket for rotationally driving the socket relative to the frame.

The socket has a center opening through the socket, so that the socket can be slid down along an elongated stud to engage a nut, and used to drive the nut to position. The reversal of operational direction is done by turning the socket and handle over, or a reversing ratchet pawl can be used in the same outer frame.

The device has a minimal number of parts, but has positive action and is configured for ease of accessibility.

The ratcheting mechanism can be either a one way or reversing drive, as shown.

BRIEF DESCRIPTION OF THE DRAWINGS

FIG. 1 is a perspective view of a powered ratchet wrench having a ratchet head made according to the present invention:

FIG. 2 is a sectional view taken along a central plane generally perpendicular to the axis of the socket and generally taken along the line 2—2 in FIG. 4;

FIG. 5 is a perspective view of a socket used with the ratchet made according to one embodiment of the present invention;

DETAILED DESCRIPTION OF THE PREFERRED EMBODIMENTS

Figure 4:
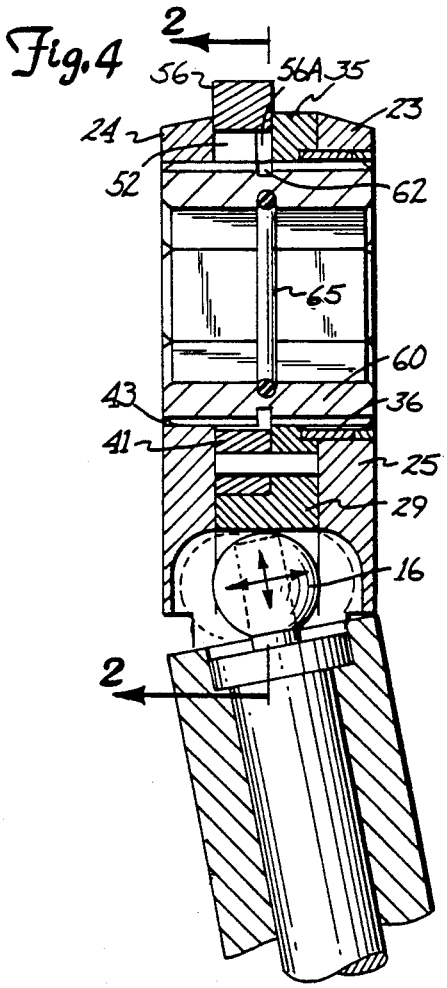
FIG. 4 is a sectional view taken as on line 4—4 in FIG. 3.

A power driven ratchet indicated generally at 10 includes an air motor 11, operated through a conventional power handle 12, and connected to a drive yoke 13 in which a drive crankshaft 15 is rotatably mounted. The drive crankshaft 15 is driven by the air motor. The yoke 13 mounts a ratchet head 14 made according to the present invention.

In FIG. 2, the crankshaft 15 is shown and with a ball member 16 slidably and rotatably mounted to a crank pin 16A at the outer end of the crankshaft. The ball crank pin 16A is eccentrically part of the drive crankshaft so that as the crankshaft 15 rotates, the ball 16 will move in an orbit about the crankshaft axis (side to side and up and down), generally as shown in the dotted lines in FIG. 2, and as will be explained, will drive a ratchet pawl mounted in the head 14. The ball also will slide axially a limited amount along the axis of the pin, as well as being able to rotate on the crank pin.

The yoke 13 has a pair of spaced-apart ears 20,20 which receive a ratchet head frame 21 therebetween. The ratchet frame 21 is pivotably mounted relative to the ears 20,20 through a pair of pivot pins 22. The heads of the pins 22 mount in suitable openings in the ears 20, and thread into support portions 26 on the frame 21.

The screws 22 permit pivoting of the yoke 13 and thus the air motor 11 on the handle about the axis passing through the pins 22.

Figure 3:
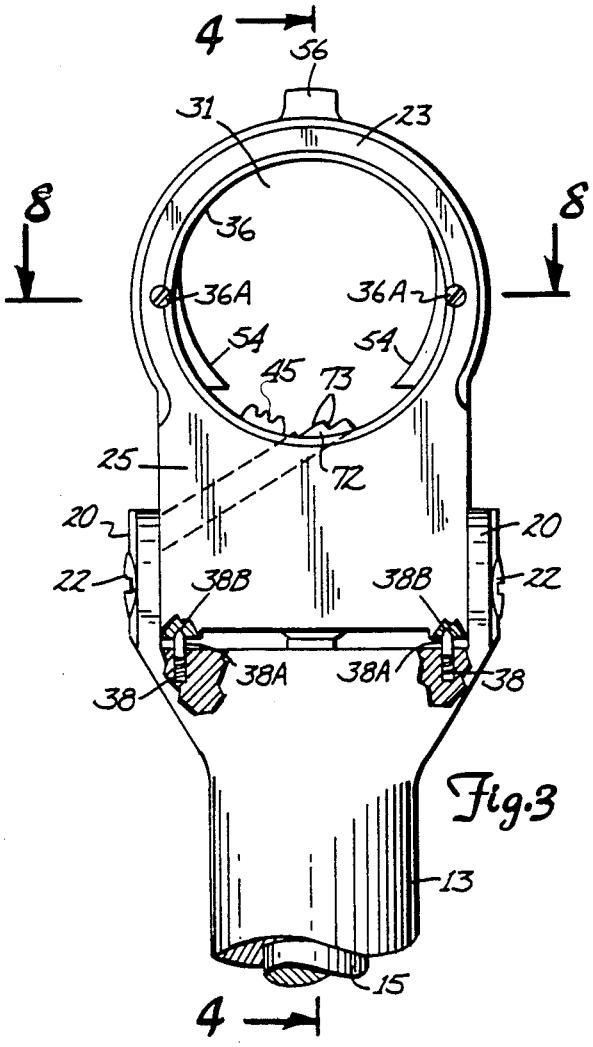
FIG. 3 is a top plan view of the ratchet shown in FIG. 1 with the socket removed.
Figure 6:
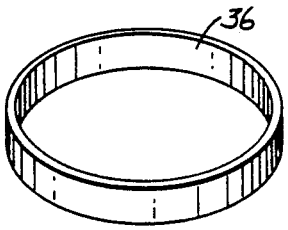
FIG. 6 is a perspective view of a retaining ring used for retaining and guiding the ratchet pawl drive ring.
Figure 8:
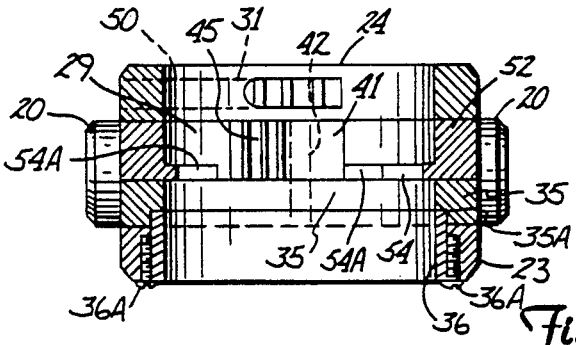
FIG 8 is a sectional view taken as on line 8—8 in FIG. 3 noting that the view of FIG. 8 becomes inverted.
Figure 7:
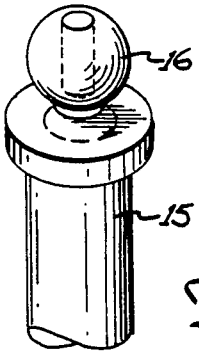
FIG. 7 is a perspective view of the drive crank used with the ratchet of the present invention.

Also shown in FIG. 3 are a pair of detent members indicated generally at 38, which are spring loaded, slidable members 38A that have points that bear against the end surfaces of the support portion 26 of the frame 21. The support portions 26 can have small dimples or recesses 38B therein into which the end portions of members 38A will fit. There may be two of these detent recesses or dimples in the support portions 26, so that the handle 13 will be detented in at least two angular positions about the pivot axis of the screws 22. For example one such position is shown in FIG. 4, and the other position can be at an opposite direction incline, as well as generally perpendicular to the axis of the socket.

The ratchet frame 20 is made with a first retaining plate 23, and a second, parallel retaining plate 24. The plates 23 and 24 are spaced apart in direction along the axis of the socket used and together form a mounting assembly. The plates 23 and 24 are both mounted on a base 25 and have through openings therein which are aligned and will receive a socket. The opening in plate 23 is larger than the opening through plate 24, but coaxial with the opening in plate 24. The base 25 includes the pair of support portions 26,26 as can be seen in FIG. 2. The support wall portions 26 are on opposite sides of a central slot opening 27 in which the ball crank member 16 will be permitted to rotate to reciprocate the ratchet pawl. The spaced-apart frame plates 23 and 24 define a flat slot 28 that extends to and intersects the slot opening 27, so a connecting passageway is formed.

The ratcheting mechanism is mounted for oscillatory movement in the slots or openings 27 and 28.

The openings through plates 23 and 24 form a through bore 31 that extends through the first and second plates 23 and 24. The socket to be driven will be positioned in the bore.

A pawl support or drive plate 35 is mounted in the slot 28, between plates 23 and 24 and has a base section 29 which fits into the slot portion 27 extending into the base 25 of the frame 20 between supports 26. The pawl support plate 35 has an irregular shape and the base section 29 in the base area 25 of the frame 21 has greater thickness in direction along the axis of the socket than the portion between the plates 23 and 24 as can be seen in FIG. 4, but the base section 29 also is recessed partially to permit pivotally mounting the pawl.

A retaining ring 36 extends partway into the socket receiving bore 31 in the frame plate 23, and partly into an annular recess forming a shoulder 35A on one side of the pawl support or drive plate 35 and which surrounds a center bore or opening 43 in the pawl support plate 35 aligning with bore 31. It can be seen in FIG. 4 that the ring 36 extends up to substantially flush with the upper surface of the frame plate 23 shown in that view, and is retained in place with a pair of small headed screws shown at 36A, threaded into the frame plate 23 on opposite sides of the bore through the frame. The heads of these screws 36A in the frame extend partially over the ring 36 to retain it in place and to hold the pawl support plate 35 in position for ratcheting action in the frame of the wrench. These screws 36A can be removed when the wrench is to be disassembled, and of course can be easily installed when the wrench is to be assembled.

As can be seen in FIGS. 2 and 4, the base section 29 of the pawl support plate 35 has a tang section 40 that has a receptacle 37 at its end that is of size to receive the ball 16 mounted on the crank pin 16A. The base section 29 also has a recess or receptacle defined on a side surface of the base section to receive a ratchet pawl 41, pivotally mounted on a pin 42 that extends partly into the base section 29 of pawl support plate 35 to hold the pawl 41 as shown in FIG. 4. The pawl 41 is positioned in the recess of the base section 29 so that it can pivot about the pin 42. The pawl 41 is urged outwardly toward the central bore 43 defined in the pawl support plate 35 by a spring 44 that has one end held in a spring receptacle in the base section 29. The other end of spring 44 fits into a recess at the back side of the pawl 41. The pawl 41 has pawl teeth shown at 45, and as will be explained, these are used for driving the socket in a ratcheting action.

It should be noted that the pawl 41 is shaped so that the spring 44 will only be able to urge the pawl outwardly as shown in FIG. 2 until one surface of the hub of the pawl abuts against the surface 48 defined in the receptacle for the pawl that is formed in the base section 29 of pawl support plate 35.

Additionally, the base section 29 has a pair of receptacles on opposite sides thereof for mounting first ends of small compression springs 50, and 51, respectively. The springs 50 and 5 bear against provided surfaces of a releasable socket retainer ring 52. The socket retainer ring has spaced guide ears 53 on opposite sides thereof. The ears are positioned on the outer sides of the outer side surfaces of the base section 29 of the pawl support plate 35 and slide relative to the base section in direction perpendicular to the socket axis. The springs 50 and 51 will urge the socket retainer ring 52 in direction along a plane perpendicular to the axis of a socket used in the frame, and thus along the plane of frame plates 23 and 24. The axis of the socket used is parallel to the pin 42. The retainer ring 52 is urged outwardly from the base end of the socket frame by the springs 50 and 51. This causes the ring 52 to be urged so that a pair of socket retaining, part annular lugs shown at 54,54 in FIG. 3 which are formed on the ring 52 along one side thereof move toward the bore 31 that is formed for receiving a socket. The ring 52 has an opening 66, that is larger than the outer of the socket.

A manual tab 56 is provided at the outer edge of the socket retainer ring 52, so that it can be pushed back toward the base of the frame against the force of springs 50 and 51, to move the part annular lugs 54 to position to clear the socket bore 31. The ring opening 66 is large enough so a socket will be permitted to pass through bore 31. The pawl support plate 35 has a recessed slot 56A for guiding the tab 56 for release movement, and also the plate 35 has recesses for the lugs 54, shown at 54A in FIG. 1.

A typical socket 60 is shown in FIG. 5, and includes a cylindrical body that has a splined toothed exterior, generally shown at 61. The spline has a suitable tooth design that will permit ratcheting. An annular groove 62 is formed on the exterior of socket 60, and as shown in FIG. 4, this groove 62 will align with the part annular lugs 54 on the socket retainer ring 52, so when the socket is pushed into place in bore 55 (through openings 31 and 43) the lugs 54 will be retracted or slid back against the action of the springs 50 and 51. The gear teeth on the socket slide past the lugs 54 through an opening in ring 52 until the lugs 54 align with groove 62 and the lugs will then snap into the groove 62. The ends of the teeth 61 are beveled to permit the socket to be slid into place through the bore 55. The interior of the socket can be provided with an internal snap ring 65 to provide a stop to prevent a nut being tightened from slipping through the socket while permitting a stud to pass through. The socket then will not slip off the nut.

Figure 9:
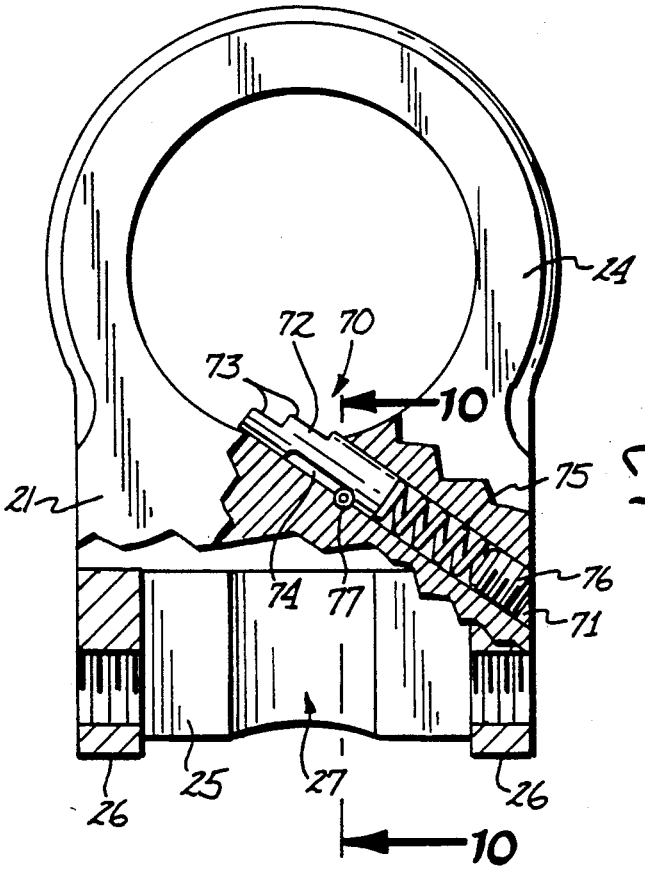
FIG. 9 is a plan view of the outer frame of the ratchet head showing a device for restraining reverse rotation of the socket during operation.

As shown in FIGS. 3 and 9, an anti-reverse device for retaining the socket 60 from merely being driven in reverse direction when the ratchet is on its return stroke is provided. This anti-reverse device is shown generally at 70, and as seen, the frame 21 has a bore 71 therein that is at an angle with respect to the axis of the drive shaft 15, and is on a plane generally with the ring 24. The bore 71 is through the base 25, and extends in from the side, and fits within the frame side members 20 when the wrench is assembled. The bore 71 slidably mounts an anti-reverse plunger or pin 72 that has teeth or notches 73 formed on the outer end thereof that will mate with the teeth 61 on the socket 60, and this anti-reverse pin 72 is held in place with a stop roll pin 77 that is at right angles to anti-reverse pin 72 and which fits partially into a recess or groove 74 in the pin 72.

This will prevent the slider pin 72 from sliding out of the bore 71, but as can be seen the slot 74 permits limited sliding travel of the pin 72 along its axis relative to stop pin 77. A spring 75 backs up to the plunger or pin 72, and the spring 75 is held in the bore with a suitable cover screw (which is headless) indicated at 76. The pin 72 will slide back and forth in the bore 71, and when the ratchet is driven by the drive ring and ratchet pawl 45, the pin 72 will retract out of the way against the action of spring 75, and teeth 73 will clear the teeth of the socket, so that the socket can be driven to tighten a nut.

In the opposite direction of rotation of the socket the teeth 73 will prevent the socket from rotating relative to the wrench frame when the ratchet pawl is on its reverse slide. The ratchet pawl 45 is offset in direction along the axis of the socket from the plunger or pin 72, and thus the socket is held from reversing related to the frame 21 during oscillation of the drive pawl. Even if the friction load on the nut is very light the ratchet will operate to tighten the nut.

Other ways (such as friction) of retaining the socket from being unintentionally driven in the opposite direction from the tightening direction also can be used, as long as the load on the socket is sufficient to prevent reverse drive and cause a ratcheting action to provide a new driving grip on the socket.

It should also be noted that an insert that has an outer surface similar on the socket 60, but which has a normal square tang on one end for receiving and driving standard sockets can be utilized. In other words, an adapter may be provided that slips into the drive opening and which has splines or teeth on the outside, but which would have a square shank or tang for receiving standard sockets at one (or both) ends. This of course would prevent the stud from passing through the socket, which is a feature of the present device, but the wrench is thus adaptable for use with conventional sockets.

The snap ring 65 will prevent the socket from slipping past the nut along a stud, for example, when the nut is being driven into place. The stop can be a small pin that is mounted in provided holes in the socket, or can be cast in dimples to prevent the nut from slipping through the socket.

In operation, then, the pawl support plate 35, and through its hub 29, the pawl 41 will reciprocate back and forth as the crank pin 16A and ball 16 are rotated by crank shaft 15 as the motor is run to ratchet the socket 60 about its central axis. As the pawl support plate 35 reciprocates, it is retained in place by ring 36 for rotation, and the socket retainer ring 52 will also be reciprocated in that the ears 53 are fitted on base 29 of pawl support plate 35. The sockets 60 are made to have suitable interior bores indicated at 68, as shown a hex bore. The bore 68 can be of different sizes for different size nuts, but the outer surface of the socket is of the same size so that the spline or teeth shown at 61 is of the same size as well.

The wrench is easily used. To remove the socket pushing the tab 56 to release the part annular teeth 54 will let the socket drop out. The socket also then quickly is reinstalled by merely pushing it into place for use with a different size socket. For driving in an opposite direction, the ratchet assembly, as shown, is flipped over, that is, turned 180° so that the driving would then be the proper direction for tightening or loosening as desired.

The conventional air motor 11 can be operated at a desired speed, and because of the pins 22, and detent members 38 the drive unit or handle can be angled relative to the axis of the socket.

The specific socket configuration also can be varied. For example, the ratchet pawls could be made to rotate with the socket on a drive ring and the pawl support or drive plate 35 could have internal teeth. The axial height of the frame would remain the same, but the socket configuration would change.

Referring to FIGS. 11–14, a modified form of the ratchet mechanism is illustrated, and the drive and the like is the same as before. The outer ratchet frame 21, including the first retraining plate 23, and the second parallel retaining plate 24 are mounted on a base 25. The plates 23 and 24 have openings that are aligned to receive a socket as previously explained, and the frame has support portions 26,26 that are suitably mounted on opposite sides of a slot opening 27 in which a ball crank member 16 and pin 16A reciprocate. The plates 23 and 24 define a flat slot 28 as in previous forms of the invention, and this intersects the slot opening 27, so a connecting passageway is formed. The ratcheting mechanism in the second form of the invention is mounted for oscillatory movement in the slots or openings 27. The plates 23 and 24 have openings forming a throughbore 31 as in the previous form of the invention, and the socket 60 to be driven, which is illustrated as being the same socket as in the first form of the invention is mounted in this bore. The socket has an external spline or teeth for driving it, and a hex opening.

Figure 10:
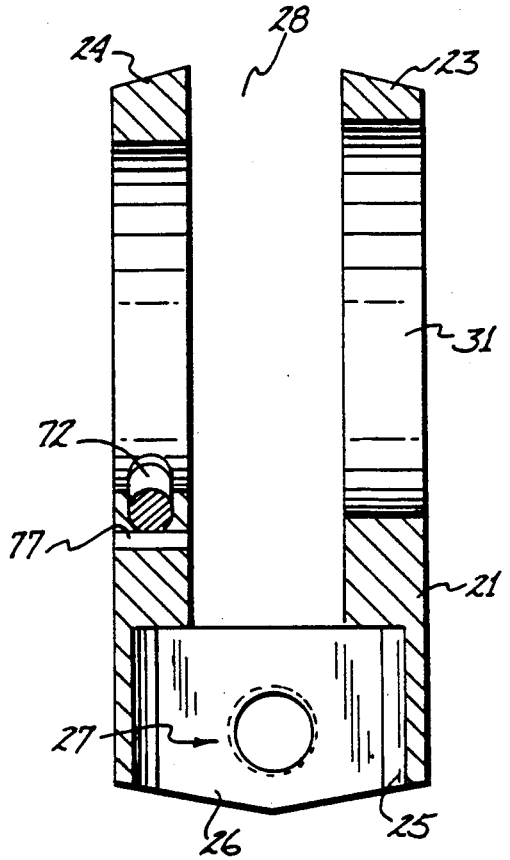
FIG. 10 is a sectional view taken on line 10—10 in FIG. 9.
Figure 11:
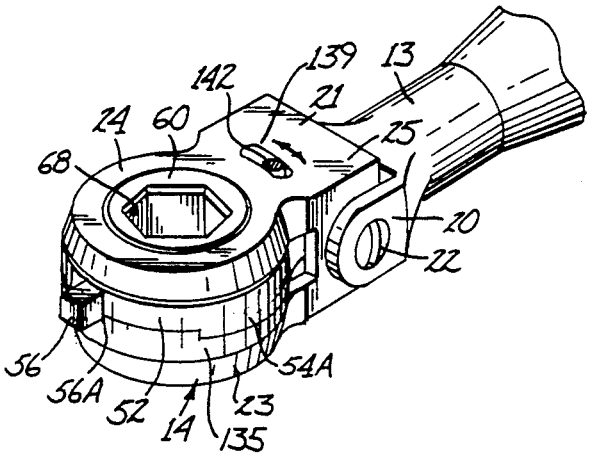
FIG. 11 is a fragmentary perspective view of a modified form of the invention having a "switch" to permit reversing the ratch direction.
Figure 12:
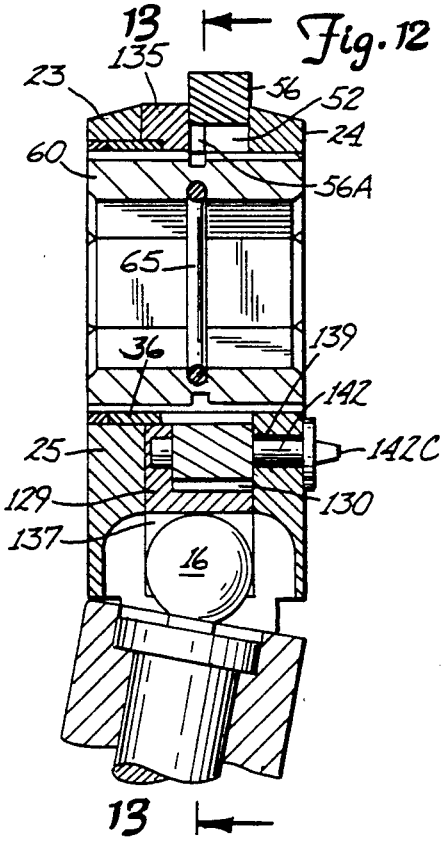
FIG. 12 is a sectional view through the center of the ratchet head shown in FIG. 11.

In this form of the invention, a modified pawl support plate 135 is mounted in the slot 28 (shown in FIG. 10), between plates 23 and 24 and has a base section 129 that fits into the slot portion 27 formed in the base 25 of the frame 21 between supports 26. Plate 135 can be seen in FIG. 12. It has a bore 143 that aligns with the bores in the frame plates 23 and 24. The pawl support plate 135 in this form of the invention also has an irregular shape and base section 129 is positioned in the base region 25 of the frame 20 and has a greater thickness in direction along the axis of the socket 60 than the thickness of the portion between the plates 22 and 23, as can be seen in FIG. 12. Base section 129 of pawl support plate 135 is recessed as shown at 130 in FIG. 13 to permit pivotally mounting a "switch" type drive pawl that can be switched to two different positions to engage the spline or teeth on the wall of a socket 60 mounted in the openings of the frame plates 23 and 24. The plate 135 also has an opening therein so the socket fits in place in the same manner as in the first form of the invention.

The retaining ring 36 is used in the same manner as before to hold the pawl support plate 135 in position in the frame 21, and it can be seen that in FIG. 12 that the ring 36 extends up to and is substantially flush with the upper surface of the frame plate and is retained in place with a pair of small headed screws shown at 36A, threaded into the frame plate on opposite sides of the bore through the frame. This is the same way that is shown in FIG. 3. The pawl support plate 135 can thus reciprocate to drive the socket as crank shaft 15 is driven.

Figure 13:
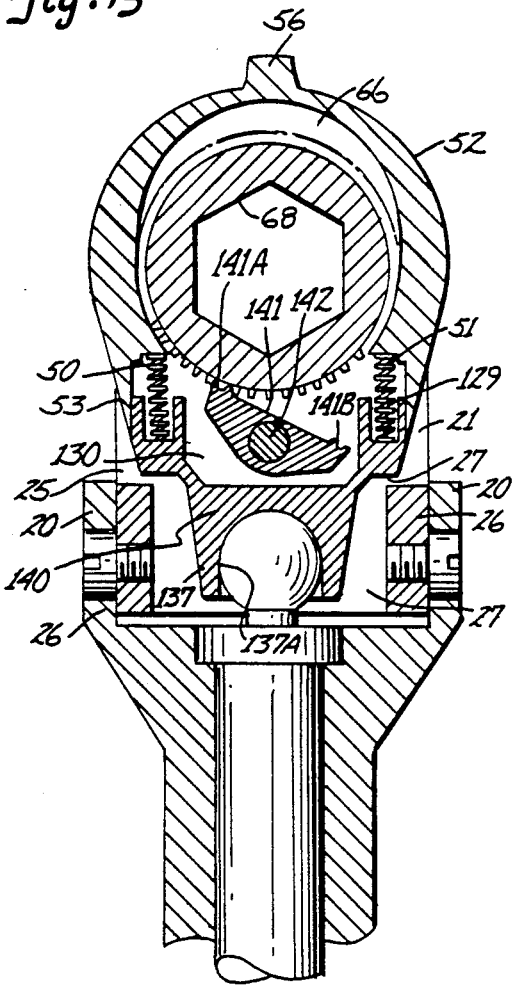
FIG. 13 is a sectional view taken as on line 13—13 in FIG. 12.
Figure 14:
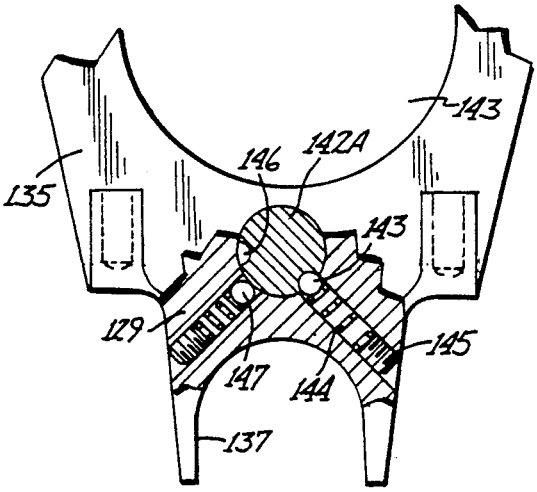
FIG. 14 is a plan view of a drive plate used in the embodiment of FIG. 13 with parts broken away to show detent details of the ratchet.

The base section 129 of the pawl support plate 35 has a tang section 140 that has a receptacle 137 at its end that is sized to receive the ball 16 mounted on the crank pin 16A that is identical to the previous form of the invention. The recess 130 is of size to receive a switching ratchet pawl 141 pivotally mounted on a pin 142 which passes through the pawl and has one end 142A extending through the pawl and pivotally mounted in the base 129 below the recess 130. The base section 129 of pawl support plate 135 thus holds the pawl 141 in position as shown in FIGS. 12, 13 and 14 for pivoting and driving movement. Pawl 141 moves with the pawl support plate 135 and is retained in place for pivoting for switching the direction of drive of the socket in the wrench. The pin 142 extends through a slot 139 in frame 21 and has an outer head 142C that forms an external switch that can be manually operated to pivot the pawl 141 about the axis of the pin 142 to a position as shown in solid lines in FIG. 13 with one or more ratchet teeth 141A engaging ratchet teeth 61 on the socket 60, to permit ratcheting the socket in counterclockwise direction. The teeth 141A will ride against the teeth 61 under a spring detent load for permitting opposite movement of the pawl support frame 135 and ratchet pawl 141.

The pin 142 can be operated through the external button or actuator 142C to a second position wherein a second teeth 141B will engage the teeth on the socket, so that the teeth 141B will be operable to drive the socket in counterclockwise direction and then ratchet back or slide back past the teeth 61 to permit the pawl teeth 141B to obtain a new "bite". In this way the ratchet is caused to operate and drive the socket 60 in either direction without removing the wrench from the nut being tightened.

The switching of direction can be done quite easily. FIG. 14 shows in enlarged scale how the pawl is detented in position with a pair of suitable detent ball members. A first ball 143 is spring loaded with a suitable spring 144 in a bore in base 129 toward portion 142A of pin 142. The portion 142A has a receptacle into which the ball 143 fits. The pin 142A has a second recess 146 to receive a second ball 147 when the pawl is moved counterclockwise to its second position. The ball 147 is spring loaded with a second spring 144 and screw 146. The ball 147 is in a second bore in the base 129.

The detent balls will hold the ratchet pawl 141 under a slight spring load and permit the pawl to ratchet back and forth. The pawl will not move away from the teeth 61 when it is in its driving position. Various kinds of detents can be used for holding the pawl in place. The pawl support plate reciprocates to drive the socket when crank shaft 15 is powered.

The need for the antireverse mechanism therefore is eliminated, and instead of having a one-way ratchet that requires the wrench to be flipped over for operation as in the first form of the invention, the present device provides for a convenient switch for either tightening or loosening nuts in either direction without changing the wrench position.

The frame is of the same low profile as in the previous form of the invention, and the compression springs 50 and 51 are used in receptacles in the base section 129 to bear against provided surfaces of the releasable socket retainer ring 52 that fits on plate 135 as in connection with plate 135 in the first form of the invention. The guide ears 53 slide against portions of the base section 29, and as shown, the socket retaining ears 54 will fit into the groove in the socket in the same manner as that previously explained.

Thus, the socket 60 can easily be removed by sliding the socket retainer ring 52 against the actions of the springs 53 to a position wherein the members 54 clear the socket groove 62 and the socket 60 can be slide out of place through the openings in the frame plate members 23 and 24 and the opening in the pawl support plate. Manual tab 56 is provided for releasing the socket in this form of the invention as well.

Although the present invention has been described with reference to preferred embodiments, workers skilled in the art will recognize that changes may be made in form and detail without departing from the spirit and scope of the invention.

What is claimed is:

1. A wrench adapted for power operation of a socket having teeth on the exterior thereof comprising:

a frame including ahead, said head having first and second aligning support plates with a first through opening defined through the plates along a socket axis perpendicular to the first and second support plates;

a pawl drive plate positioned between said support plates for reciprocation centered on said axis, and including a second opening of size to align with the first through opening and having a base end;

a pawl mounted at said base end of the pawl drive plate, adapted to be moved to a drive position extending into the second opening;

socket retainer means mounted between said first and second support plates and on one side of said pawl drive plate and guided for reciprocal movement in a plane generally parallel to the plates; said socket retainer means having at least one lug extending into the opening of the pawl drive plate to provide a socket retainer lug, said socket retainer means having an opening of such size that a socket will pass through the opening defined in the support plates past the socket retainer lug;

means for urging said socket retainer means to move the socket retainer lug to position protruding into the through opening defined by the support plates so that a socket fitting into the through opening is engaged and retained in position by said socket retainer lug; and pawl drive means to reciprocate the pawl drive plate and pawl thereon to affect a drive in at least one direction of a socket having pawl engagable teeth on the exterior thereof and which is retained by the socket retainer lug, said socket retainer means being movable to a second position wherein the socket retainer lug clears the through opening of the support plates and permits a socket to move axially of the through opening of the support plates.

2. The apparatus as specified in claim 1 in combination with a socket having exterior teeth of substantially uniform outer diameter and an annular groove for receiving the socket retainer lug, said socket having a center opening therethrough for passing a threaded member therethrough, and at least a portion of the center opening of the socket being configured to fit onto a nut for a threaded member.

3. The apparatus of claim 2 and a stop on the interior of the socket to prevent a nut on which the socket fits from passing through the socket.

4. The apparatus of claim 1 and means to restrain a socket positioned in the through opening from rotational movement in a second direction opposite from the first direction.

5. The apparatus of claim 1 wherein said pawl drive means comprises a camshaft having a means to pivotally engage said pawl drive plate and cause the reciprocation thereof.

6. The apparatus of claim 1 and a retainer engaging a portion of the frame and a portion of the pawl drive plate for maintaining the pawl drive plate in position with the opening in the pawl drive plate substantially coaxial with the through opening in the first and second support plates while permitting the reciprocating movement of the pawl drive plate.

7. The apparatus of claim 1 wherein said pawl is pivotally mounted on the pawl drive plate and movable between two positions to permit driving a socket retained by the socket retainer lug selectively in opposite direction of rotation.

8. The apparatus as specified in claim 7 wherein said ratchet means comprises a ratchet pawl having teeth on the outer edge thereof protruding into the socket opening in position to mate with spline means formed on the exterior of a socket adapted to be mounted on the second means.

9. A low profile power wrench comprising:

a frame including a head, said head having first and second spaced apart aligning generally planar support plates, each defining a plane and having a first through opening defined through both of the plates along an axis perpendicular to the planes of the first and second plates, said support plates each being thin in direction along the axis and defining a narrow band lying in the plane of the respective plate and surrounding the opening;

drive means positioned between said first and second plates for reciprocation about said axis, said drive means including a drive plate having a second opening of size to align with the first through openings, said drive plate having a base end that is slidably received between the support plates and contiguous to portions of the support plates;

a drive shaft mounted on the frame and having an axis generally parallel to the planes of the first and second support plates and having a crank pin engaging the base end of the drive means for reciprocating the first drive means when the shaft is rotated under power;

retainer means supported on the drive plate and positioned between a portion of one of the first and second support plates and portions of the drive plate and substantially surrounding the opening therein for releasably mounting a socket for rotation with respect to the first and second support plates and the drive plate when the retainer means is in a first position, the drive plate and retainer means forming an assembly directly supported on facing surfaces of the support plates for reciprocal movement about the opening axis; and ratchet means operable from the first drive means to a socket mounted on the retainer means under a ratcheting action as the drive means is reciprocated under power.

* * * * *